US008968160B2

(12) United States Patent
Cassano

(10) Patent No.: US 8,968,160 B2
(45) Date of Patent: Mar. 3, 2015

(54) TREADMILL BELT SUPPORT ASSEMBLY

(75) Inventor: Robert Cassano, Franklin, MA (US)

(73) Assignee: Cybex International, Inc., Medway, MA (US)

( * ) Notice: Subject to any disclaimer, the term of this patent is extended or adjusted under 35 U.S.C. 154(b) by 1532 days.

(21) Appl. No.: 12/029,529

(22) Filed: Feb. 12, 2008

(65) Prior Publication Data

US 2008/0312048 A1 Dec. 18, 2008

Related U.S. Application Data

(60) Provisional application No. 60/944,235, filed on Jun. 15, 2007.

(51) Int. Cl.
*A63B 22/02* (2006.01)

(52) U.S. Cl.
CPC ..... *A63B 22/0235* (2013.01); *A63B 22/0257* (2013.01); *A63B 22/0285* (2013.01); *A63B 2225/30* (2013.01)
USPC ..... 482/54

(58) Field of Classification Search
USPC ..... 482/54, 51–52; 198/840–848; 37/242–243
See application file for complete search history.

(56) References Cited

U.S. PATENT DOCUMENTS

| | | | | | |
|---|---|---|---|---|---|
| 3,722,665 | A * | 3/1973 | Probasco | 198/689.1 |
| 3,746,264 | A * | 7/1973 | Diener et al. | 239/668 |
| 3,809,003 | A * | 5/1974 | Foldvari | 440/29 |
| 4,073,376 | A * | 2/1978 | Krooss | 198/498 |
| 4,635,928 | A * | 1/1987 | Ogden et al. | 482/54 |
| 5,054,608 | A * | 10/1991 | Bryant | 198/816 |
| 5,447,479 | A * | 9/1995 | Gvoich | 482/54 |
| 5,752,897 | A * | 5/1998 | Skowronski et al. | 482/54 |
| 7,367,926 | B2 * | 5/2008 | Clark | 482/54 |
| 7,553,260 | B2 * | 6/2009 | Piaget et al. | 482/54 |
| 2001/0051563 | A1 * | 12/2001 | Turak et al. | 482/54 |
| 2005/0233864 | A1 * | 10/2005 | Smith et al. | 482/52 |
| 2007/0027003 | A1 * | 2/2007 | Clark | 482/54 |
| 2008/0312048 | A1 * | 12/2008 | Cassano | 482/54 |

* cited by examiner

*Primary Examiner* — Robert Long
(74) *Attorney, Agent, or Firm* — ;Novak Druce Connolly Bove + Quigg LLP

(57) ABSTRACT

A treadmill comprising:
a pair of rollers mounted on a frame;
an endless running belt wound around the rollers under a selected tension;
at least one of the rollers having a roller pulley for receiving a drive belt;
a drive mechanism comprising a driven rotor having a drive pulley;
the drive belt being wound around the roller pulley and the drive pulley at a drive tension created by the selected tension in the running belt.

22 Claims, 6 Drawing Sheets

TREADMILL BELT SUPPORT ASSEMBLY

RELATED APPLICATIONS

This application claims the benefit of priority of U.S. Provisional Application Ser. No. 60/944,235 filed Jun. 15, 2007, the disclosure of which is incorporated herein by reference in its entirety as if fully set forth herein.

BACKGROUND OF THE INVENTION

Exercise treadmills have conventionally used an endless running belt that is supported on a pair of rollers, front and back, with the running belt serving no purpose other than a platform for rotation on the rollers. One of the two rollers is typically driven or otherwise interconnected to a drive mechanism that is movable in order to enable maintenance of the belt system.

SUMMARY OF THE INVENTION

The present invention relates to belts and drive systems used in treadmills and similar devices. More particularly the present invention relates to an apparatus and method for maintaining a drive belt for a pulley of a driven roller of a treadmill under tension and for enabling ready removal and replacement of the drive belt. In accordance with the invention there is provided an apparatus and method for mounting a drive belt in a treadmill, the apparatus comprising a rotational drive mechanism mounted on a frame, the drive mechanism being interconnected via the drive belt to an axle of one of a pair of rollers around which are wound a treadmill belt wherein the rollers are mounted on the frame so as to create a selectable tension or force in the treadmill belt wherein the axle of the one of the pair of rollers is mounted and the interconnection of the drive belt are adapted to transmit at least a portion of the tension or force in the treadmill belt to the drive belt.

In accordance with the invention there is provided, a treadmill comprising:

a pair of rollers mounted on a frame;

an endless running belt wound around the rollers under a selected tension;

at least one of the rollers having a roller pulley for receiving a drive belt;

a drive mechanism comprising a driven rotor having a drive pulley;

the drive belt being wound around the roller pulley and the drive pulley at a drive tension created by the selected tension in the running belt.

The drive mechanism is preferably fixedly mounted to the frame, the drive tension in the drive belt being created by the selected tension in the running belt pulling against the fixedly mounted drive mechanism through the drive pulley.

At least one of the drive pulley and the roller pulley is preferably adapted to enable the drive belt to be readily manually released from being wound around the drive pulley or the roller pulley upon relaxation of tension in the roller belt to a selected degree.

The at least one roller having the roller pulley is preferably movable toward the fixedly mounted drive mechanism upon relaxation of the selected tension in the roller belt a distance sufficient to enable the drive belt to be readily manually released from being wound around the drive pulley.

The roller pulley is typically mounted on an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

The roller pulley is typically mounted on an axle that is slidably mounted within a slot mechanism for back and forth travel within a slot, the slot mechanism having a release aperture for removal of the axle from the slot on relaxation of the tension in the roller belt to a selected degree.

The treadmill can further comprise a mechanism for selectively adjusting the selected tension in the roller belt.

The mechanism for selectively adjusting the selected tension in the roller belt 16 typically comprises a separation adjustment device 80 fixedly interconnected to the frame 20 and adjustably engageable with one of the rollers to enable the rollers to be adjustably moved toward F and away TD from each other.

In another aspect of the invention there is provided a treadmill comprising:

a pair of rollers mounted on a frame;

an endless running belt wound around the rollers;

at least one of the rollers having a roller pulley for receiving a drive belt;

a drive mechanism comprising a driven rotor having a drive pulley, the drive belt being wound around the roller pulley and the drive pulley;

the drive mechanism being fixedly mounted to the frame; the running belt being maintained under a selected tension that acts through the roller pulley to maintain the drive pulley under tension.

In such an embodiment, the rollers are preferably adjustably movable toward and away from each other to enable the tension in the running belt to be selectively adjusted.

In such an embodiment the treadmill preferably further comprises a separation adjustment device 80 fixedly interconnected to the frame 20 and adjustably engageable with one of the rollers to enable the rollers to be adjustably moved toward F and away TD from each other.

The roller pulley is preferably mounted on an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

The roller pulley is typically mounted on an axle that is slidably mounted within a slot mechanism for back and forth travel within a slot, the slot mechanism having a release aperture for removal of the axle from the slot on relaxation of the tension in the roller belt to a selected degree.

In such an embodiment the treadmill preferably further comprises a mechanism for selectively adjusting the selected tension in the roller belt.

Further in accordance with the invention there is provided a treadmill comprising:

a pair of rollers mounted on a frame;

an endless running belt wound around the rollers under a selected tension;

at least one of the rollers having a roller pulley for receiving a drive belt;

a drive mechanism comprising a driven rotor having a drive pulley, the drive belt being wound around the roller pulley and the drive pulley;

the drive mechanism being fixedly mounted to the frame;

at least one of the drive pulley and the roller pulley being adapted to enable the drive belt to be readily manually released from being wound around the drive pulley or the roller pulley upon relaxation of the selected tension in the roller belt to a selected degree.

The roller pulley is mounted on an axle that is slidably mounted within a slot mechanism for back and forth travel within a slot, the slot mechanism having a release aperture for removal of the axle from the slot on relaxation of the tension in the roller belt to a selected degree.

The roller pulley is mounted on an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

The treadmill typically further comprises a mechanism for selectively adjusting the selected tension in the roller belt.

The mechanism for selectively adjusting the selected tension in the roller belt 16 preferably further comprises a separation adjustment device 80 fixedly interconnected to the frame 20 and adjustably engageable with one of the rollers to enable the rollers to be adjustably moved toward F and away TD from each other.

In another aspect of the invention there is provided, a treadmill comprising:

a pair of rollers mounted on a frame;

an endless running belt wound around the rollers under tension;

at least one of the rollers having a roller pulley for receiving a drive belt;

a drive mechanism comprising a driven rotor having a drive pulley, the drive belt being wound around the roller pulley and the drive pulley;

the drive mechanism being fixedly mounted to the frame;

the roller pulley being mounted for back and forth travel toward and away from the drive mechanism.

In such an embodiment the roller pulley preferably includes an axle that is slidably mounted within a slot mechanism for back and forth travel within a slot, the slot mechanism having a release aperture for removal of the axle from the slot on relaxation of the tension in the roller belt to a selected degree.

In such an embodiment the tension in the running belt creates tension in the drive belt and wherein the roller pulley is includes an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

BRIEF DESCRIPTION OF THE DRAWINGS

The above and further advantages of the invention may be better understood by referring to the following description in conjunction with the accompanying drawings in which.

DETAILED DESCRIPTION

Figure 1:
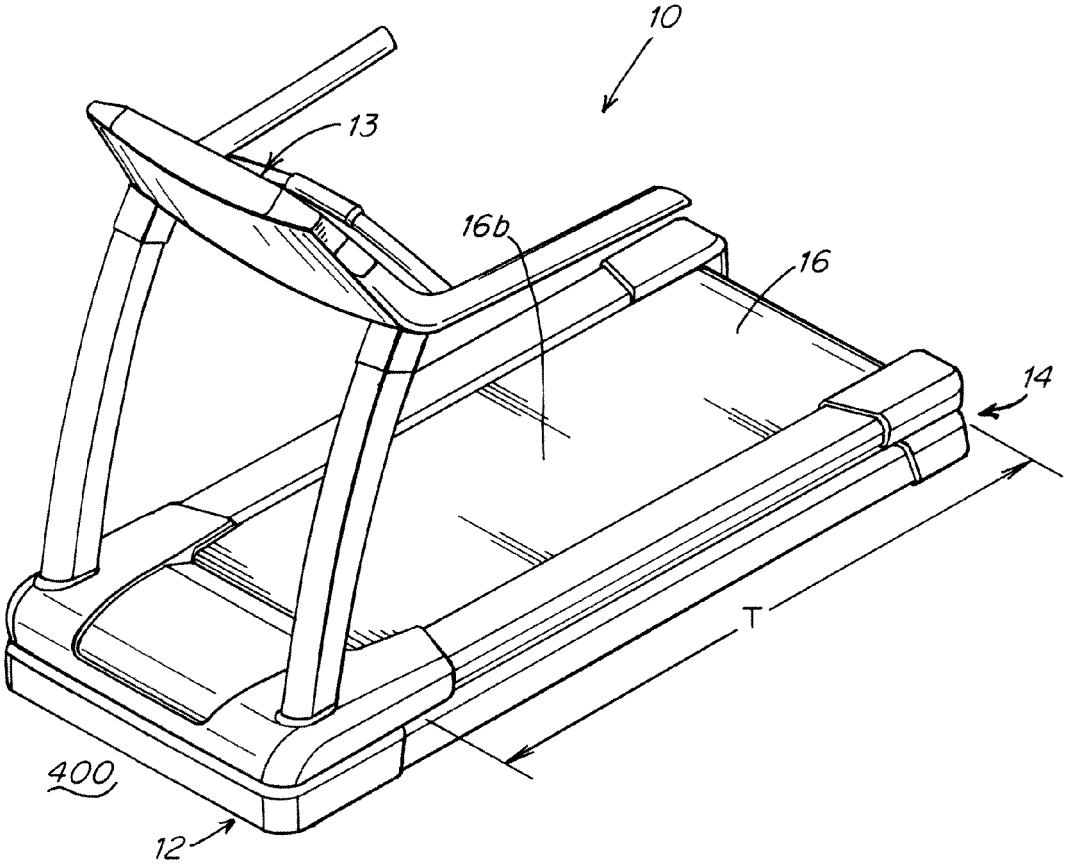
FIG. 1 is a front left perspective view of a treadmill in accordance with the invention.
Figure 2:
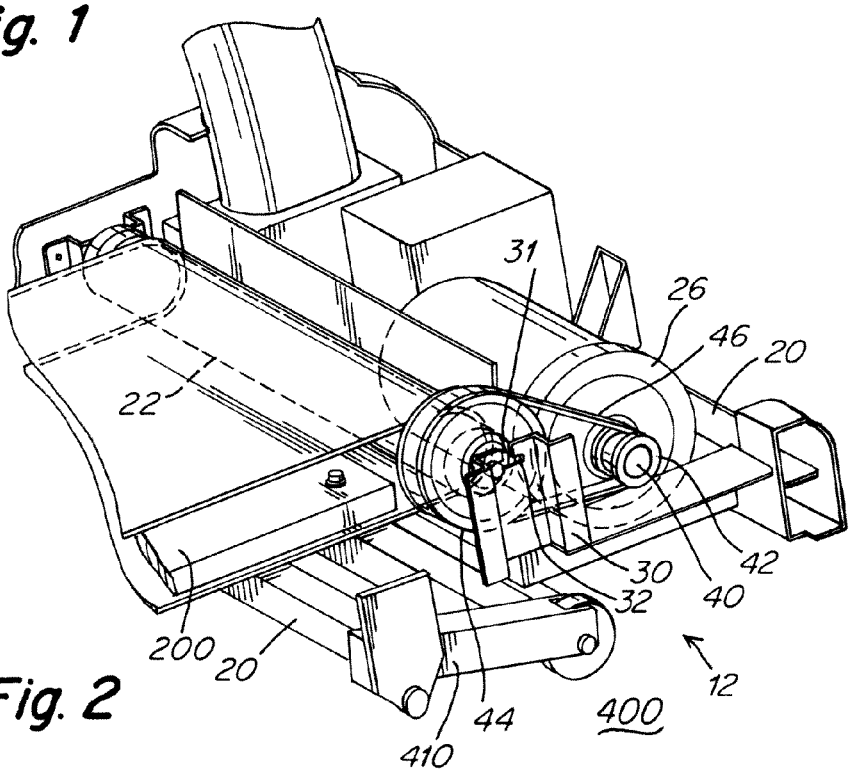
FIG. 2 is a right side Perspective view of the drive motor and front roller pulley of the treadmill of FIG. 1, showing the interconnection of the two via a drive belt and pulleys of FIG. 1.
Figure 3:
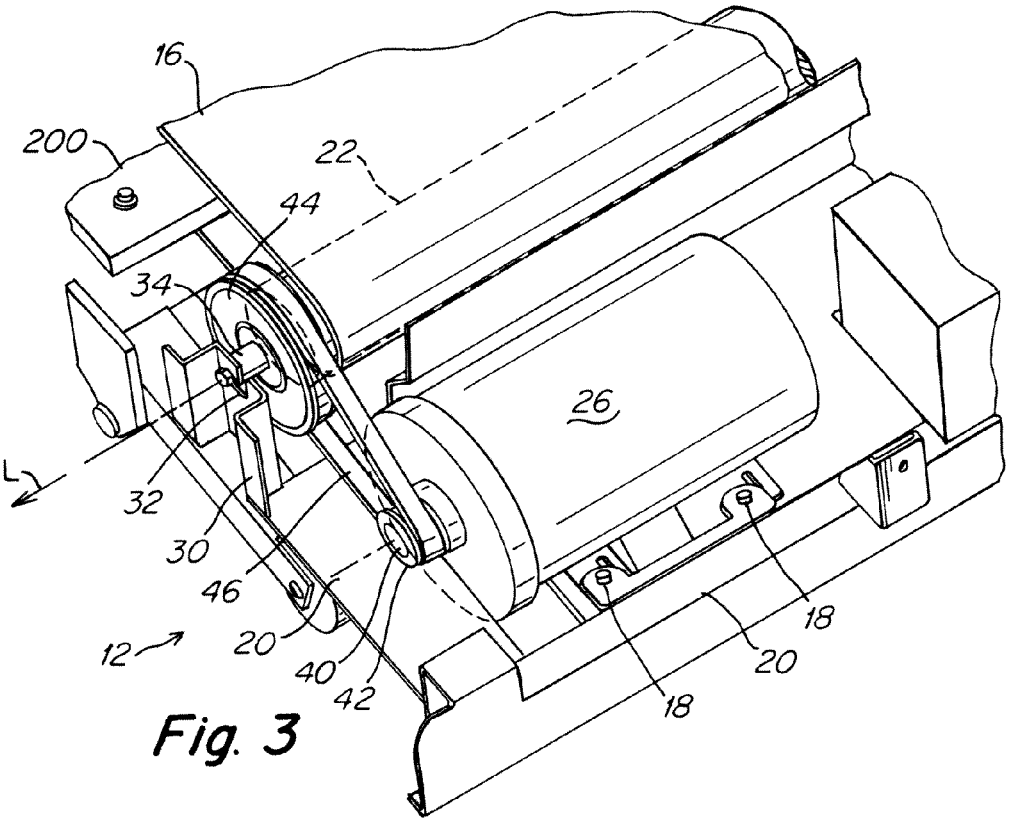
FIG. 3 is a front perspective view showing the same components shown in FIG. 2.

With reference to the accompanying figures, FIG. 1 shows a treadmill 10 having a front end 12, a rearward end 14 and an endless belt 16 on which a user stands. At the front end 12 of the treadmill a motor 26 is stationarily mounted by bolts or similar means 18 to the frame 20 of the treadmill, i.e. the motor and its housing do not pivot or slide or otherwise move on or relative to the frame 20. The frame 20 is a rigid structure on which all of the operating components of the treadmill 10 are mounted. The frame typically comprises an assembly of rigid struts, linkages and the like that are rigidly interconnected to each other by bolts, welding or other conventional means. The frame 20 is typically comprised of a rigid, dimensionally stable metal material. As shown in FIGS. 2, 3 the forward end of the belt 16 is wrapped under tension around a front end roller 22 and a rear end roller 24. The running belt has a small degree of ability to stretch under tension. As mounted around the front 22 and rear 24 rollers, the running belt is formed as an endless belt 16 that remains and is maintained laterally in position on the rollers when the rollers are distanced away from each other to a sufficient extent as to create a tension T in the belt 16 thus causing the belt 16 to be frictionally engaged with the rollers 22 and 24 such that the belt 16 does not move laterally/radially along the rollers 22, 24. The tension T between the axles of the front 22 and rear 24 rollers ranges between about 100 and about 1000 pounds in the mounted positions of the rollers as shown in the Figures. Typically the rollers 22, 24 are mounted such that the tension T between the axles is between about 500 and about 900 pounds, and most typically between about 600 and about 800 pounds. The tension T is adjustable and selectable and is selected to be at least great enough to create a tension T2 in drive belt 46 sufficient to enable belt 46 to frictionally engage pulleys 42, 44 and enable pulley 42 and motor 26 to rotatably drive roller 22 when frictionally engaged with the roller belt 16.

Figure 4:
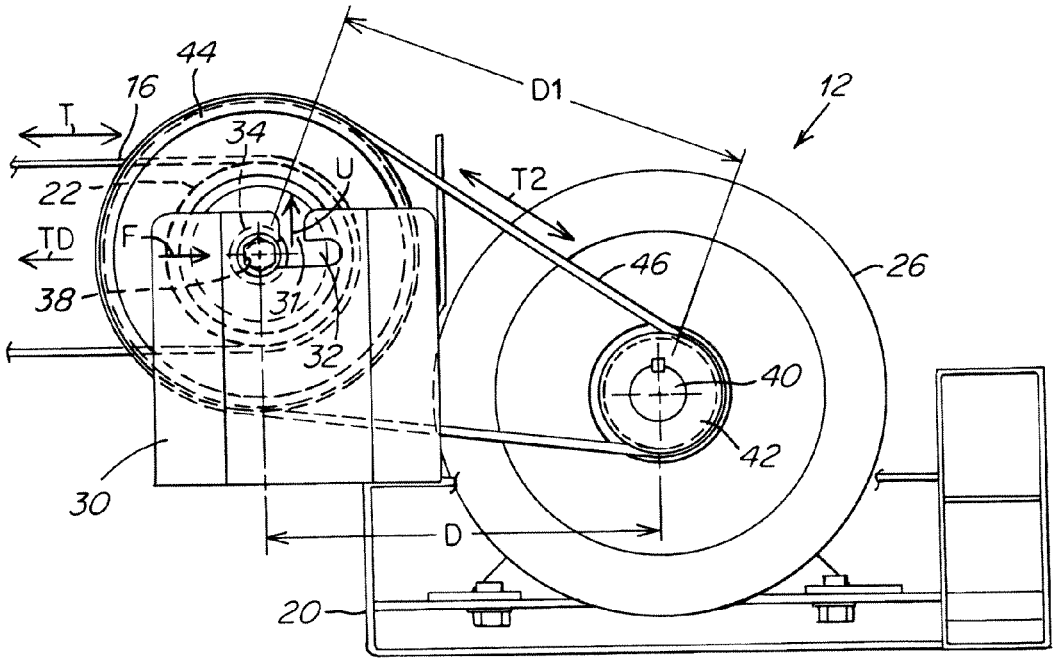
FIG. 4 is a side view of the assembly shown in FIG. 2.
Figure 4A:
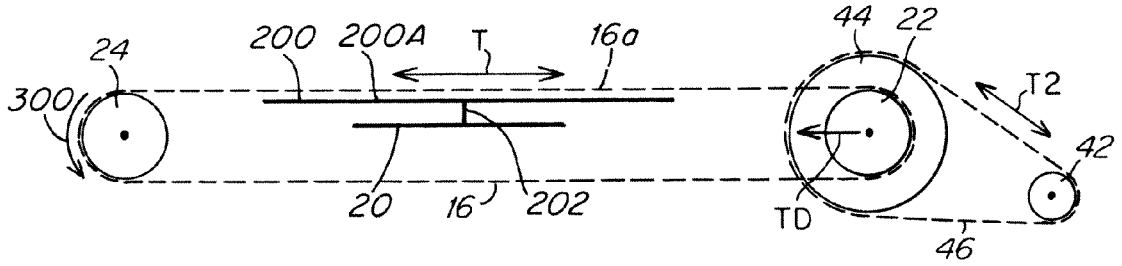
FIG. 4A is a schematic side view of the treadmill of FIG. 1 showing the relationship of the rollers, running belt, motor and belt pulleys and drive belt components of the FIG. 1 treadmill.

In practice, the treadmill 10, FIG. 4A includes a support platform 200 that is mounted via mounting mechanism 202 on the frame 20. The platform 200 typically comprises a planar sheet or board comprised of dimensionally stable material such as wood or plastic. The support platform 200 lies beneath the undersurface of the vertically upper running portion 16*a* of the running belt 16 on the user of the device physically stands or runs with their feet. The belt 16 rotates 300 together with the rotating rollers 22, 24 due to the tension in the belt and its frictional engagement with the outside surfaces of the rollers 22, 24. The undersurface of the upper running portion of the belt 16*a* slides over the top surface 200*a* of the platform 200 as the belt 16 rotates 300 together with the rollers 22, 24. When a user stands on the main upper surface area 16*b* of the running belt, FIG. 1, the user's weight is upwardly supported by the support platform 200 via its mounting on the frame 20, the weight of the user causing the undersurface of the upper portion 16*b* of the running belt to frictionally engage the top surface 200*a* of the support platform. The frame 20 is typically mounted on the floor 400, FIGS. 1, 2. The front end of the apparatus 10 typically includes a rotatable wheel that enables rollable movement of the apparatus 10 along the floor 400 the wheel being interconnected to the frame 20 via a spring loaded leg or similar shock absorbing or cushioning mechanism 410 for cushioned mounting of the apparatus 10 on a stable floor 400 or other fixed stable surface. The leg 410 is interconnected to the rigid frame 20. Similarly, the support platform 200 is typically mounted to the frame 20 through or to a spring or other shock absorbing or cushioning member 202 so that when a user runs on the top surface 16*a* of the belt 16, the downward and other forces exerted on the belt 16 by the user are better absorbed or cushioned by the frame 20 through the cushioning mechanism 202.

The axle 34 of the front roller 22 is mounted to and projects outwardly from the axis of roller 22 on both ends of roller 22 such that the roller 22 does not move radially or axially relative to the axle 34, i.e. the axle 34 and roller 22 are mounted to each other such that the roller 22 does rotate around the axis of the roller 22 when the axle is mounted within the slot 32. On one end of the roller 22, the right hand side end as shown in the figures, axle 34 is mounted in a generally horizontally oriented slot 32 that extends from front to back of the apparatus 10. The front to back or rearward to frontward extending slot 32 is provided in a bracket 30 that itself is rigidly or stationarily mounted in a vertically upright orientation on the frame 20. The axle 34 extends through the slot 32 and abuts a rearward edge 38 of the slot that is positioned in a preselected position so as to create a preselected direct distance D1 and/or a preselected lateral distance D between the axis 34 of roller 22 and roller pulley 44 and the rotor 40 of a driven motor pulley 42. The distance D or D1 is preselected together with the radius or diameter of pulleys 42 and 44 and the length of belt 46 so as to create a preselected tension T2 in the drive belt 46.

The tension in belt 46 is created by the pull or tension T in belt 16 which pulls the axle 34 in the backward direction T shown in FIG. 4 causing the axle to be pulled against the rearwardmost edge 38 of slot 32 in which the axle 34 is slidably mounted. The length of belt 46, distances D and/or D1, the diameters of pulleys 42, 44 and the position of the stop edge 38 of slot 32 are all preselected to create and maintain a predetermined degree/amount of tension in belt 46 within a predetermined range that is appropriate for the type of belt 46 employed. The absolute value of the range of desired tension in belt 46 depends and varies depending on the construction of belt 46 itself, e.g. depending on the materials of which belt is made, its width, thickness, length, configuration and the like. Typically for commercially available motor drive belts the predetermined amount of tension created in belt 46 is between about 60 and about 200 pounds.

Axle 34 is disengageable or removable from slot 32 by reducing or eliminating or relieving the tension T in running belt 16 to the point where, as a result of removal/elimination/release of the backward pulling force T, FIG. 4, the center of axle 34 can be slid in the forward direction F into horizontal alignment with vertical/removal slot 31 at which point axle 34 can be lifted in an upward direction U out of slot 32 entirely. Upon release or elimination of tension T in belt 16, the tension T2 in belt 46 is also released, eliminated or relieved due to the fact that there is no longer a backward force/tension T causing the axle 34 to be pulled backwardly away from fixed rotor 40.Rotor 40 of motor 26 is held in a fixed/stationary position by virtue of the fixed bolting of motor 26 to the frame 20 by bolt, weld, screw or other means.

Once the tension T2 in belt 46 is released/eliminated, and axle 34 is removed from slot 32 by upward U movement of the axle 34 through slot 31, the drive belt 46 can be unwound/removed from engagement around pulley 44 by pulling the drive belt 46 in the lateral direction L, FIG. 4 off and past the lateral most extension point of axle 34. Drive belt 46 is fully removable by similarly laterally pulling the belt 46 from engagement around motor pulley 42. Once fully removed from pulleys 44 and 42, a new drive belt can be readily and quickly manually placed around both pulleys 42 and 44 while the axle 34 is still disengaged/removed from slot 32. Once a new drive belt is wound around pulleys 42, 44, the roller axle 34 can be reinserted into slot 32 through slot 31 and the tension T in running belt 16 re-established as described below to re-establish tension T2 in the new belt 46.

Figure 6:
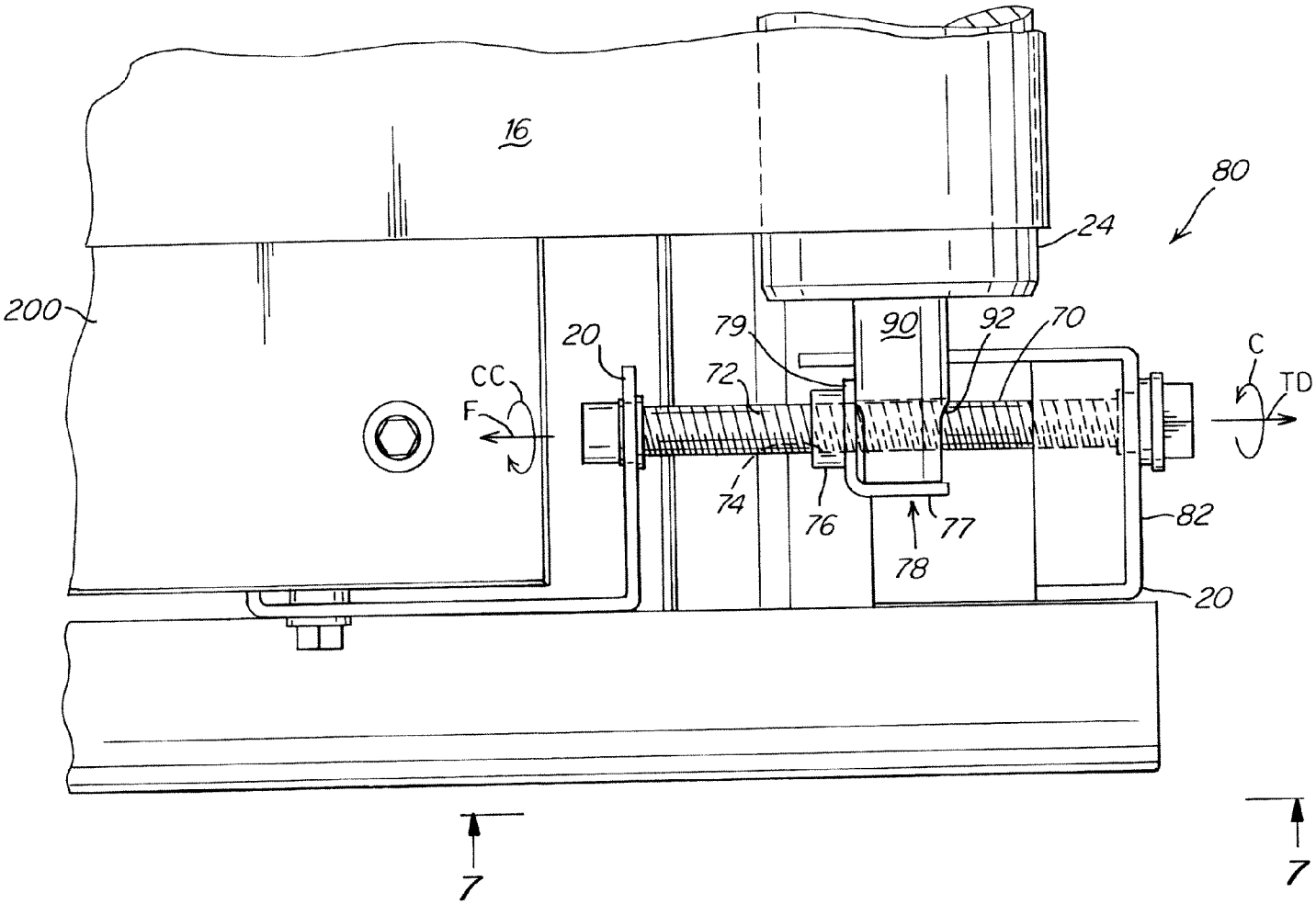
FIG. 6 is a top left side view of the rear roller adjustment mechanism shown in FIG. 5.
Figure 7:
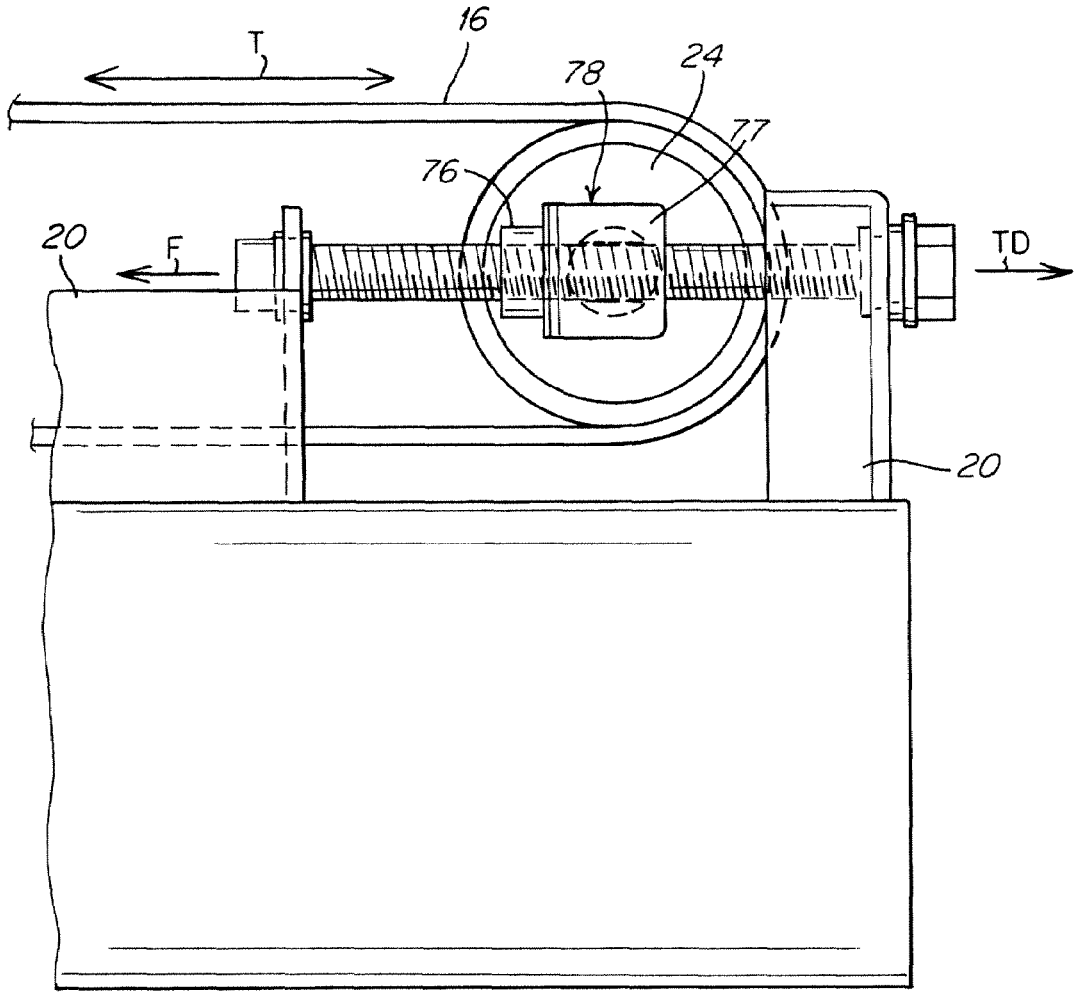
FIG. 7 is a left side view of the rear roller adjustment mechanism shown in FIG. 5.

With reference to FIGS. 6-8, the degree of tension T in running belt 16 is controllably variable by the user by operation of rear separation adjustment device 80. Typically two such mechanisms are mounted to the rear portion of the frame, equidistant from the center of the belt 16 on the left and right rear sides of the frame. FIGS. 7, 8 illustrate a left rear side separation adjustment device 80, the right side mechanism not being shown. As shown, the roller separation adjustment device 80 is comprised of a bolt 70 having a threaded portion 72 that is screwably engaged with a complementary threaded portion 74 of the aperture 75 of a nut 76 that is press fit within a flanged abutment mechanism 78. As shown in FIGS. 6, 7, the bolt 70 extends through an aperture 92 that extends radially through the rear axle 90 of rear treadmill belt roller 24, the exterior diameter of the nut 76 being mounted within the radial aperture through the axle 90 and the flange mechanism 78 having a first flange portion 79 that is arranged to abut against the outside surface of the rear axle and a second flange portion 77 that is arranged to abut against a frame portion (not shown) for purposes of enabling the bolt 70, 72 and nut 74, 76 to better engage against the outside radial/circumferential surface of the rear axle 90. When the bolt 70 is turned/rotated about its axis in a preselected direction, e.g. clockwise C, FIG. 7, the screwably engaged nut 76 will translate in the rearward TD direction and eventually with a sufficient degree of rotation C, the nut 76 will push the front face of flange portion 79 against the outside radial surface of axle 90 thus moving axle 90 and roller 24 in the rearward TD direction and creating a tension T, FIG. 1, in belt 16 to/of a degree that is selected by the user depending on the degree to which bolt 70 is rotated C around its axis.

Figure 5:
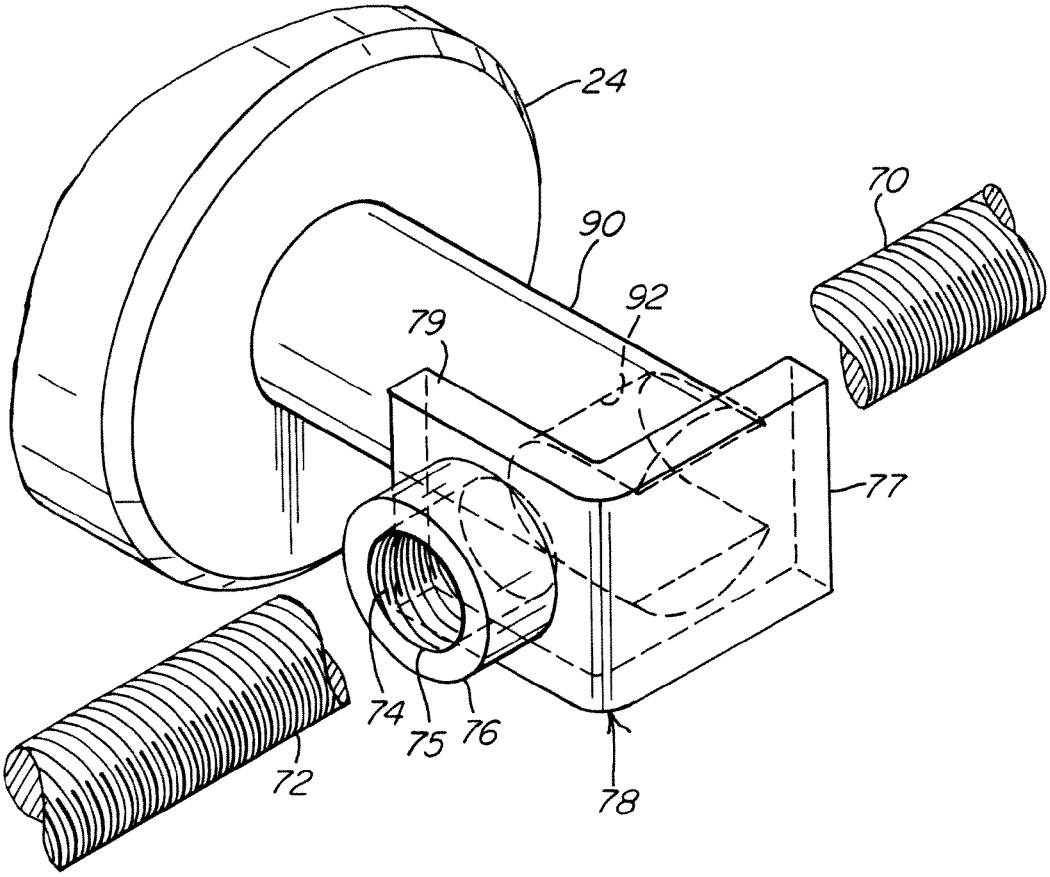
FIG. 5 is a left side perspective view of the rear roller adjustment mechanism of the treadmill of FIG. 1.

As shown, FIGS. 5-7, the rear axle 90 of the rear roller 24 is vertically supported on the frame 20 via the bolt 70, 72 (left side only shown) that is engaged within the axle receiving aperture 92, the bolt 70, 72 being mounted at is distal end 70 and proximal end 72 on the components shown which are affixed to the frame 20.

Similarly, any tension T, FIGS. 1, 8 that may exist in belt 16 may be lessened, relieved or eliminated completely by rotating bolt 70 in the opposite direction CC to a selected degree to cause nut 76 to move in the forward direction F. If tension T exists in belt 16, axle 90 and roller 24 will move forwardly F together with forward movement F of nut 76 under the force of tension T. The tension T in belt 16 can be completely relieved/eliminated by turning bolt 70 to a degree sufficient to move nut 76 and associated flange element 78 forwardly F enough such that the running belt 16 is no longer stretched between the front and rear rollers and is in a relaxed state.

Once the running belt 16 is in a relaxed state and no longer under tension T, FIGS. 4, 5, the tension T2 in belt 46 is also relaxed or eliminated and the axle 34 of the front roller and pulley 44 can then be slid forwardly F, FIG. 3, through slot 32 into alignment with slot 31 to remove axle 34 from slot 32 entirely to enable replacement of drive belt 46 as described above.

In the embodiments described, the adjustment bolt 70 is screwably engaged with nut 76 as a mechanism for forcibly moving the rear roller 24 backward and forward. Other mechanisms can alternatively be used. For example, the interior surface of aperture 92 of axle 90 could be provided with a complementary set of teeth to engage directly with the screw teeth 73 provided on the surface of bolt 70. Elastic pull mechanisms (not shown) attached to the frame could alternatively be provided to pull the axle 90 of the rear roller 24 rearwardly TD. A push screw mechanism, as opposed to the pull screw 70 mechanism, could alternatively be provided. Pneumatic or hydraulic actuators/cylinders connected between the frame and the axle of one or the other of the rollers could also be employed. Any mechanism that enables controllable movement of the axle one roller 22, 24 relative to the other can be employed, i.e. that enables controlled variation of the front to back orthogonal distance between the axes of the two rollers when mounted in substantially parallel relationship to each other.

Rotation and driving of the shaft of the motor 26 by conventional means (e.g. electricity, fuel, spring or the like mechanism) rotates the pulley 42 which is fixedly attached to the shaft of the motor 26. Drive belt 46 is wound around the outside circumferential edge of pulley 42 under tension as described below. Thus as pulley 42 is drivably rotated around rotor 40, drive belt 46 is drivably rotated together with the drivably rotated pulley 42. As shown, drive belt 46, FIGS. 3-5 is also wound around roller pulley 44 under tension as described below. Pulley 44 is fixedly attached to axle 34 of roller 22. The driven rotation of belt 46 in turn drivably rotates front roller 22. The driven rotation of roller 22 by belt 46 through pulleys, 42, 44 and axle 34 in turn drivably rotates running belt 16 which is also tension mounted on and around the outer circumferential surface of roller 22.

Motor 26 is controllably drivable at predeterminable and user selectable speeds at and for predeterminable and user selectable intervals of time by interconnection to programmed or programmable electronic control mechanisms such as computers, microprocessors and the like. Such electronic controls have user interfaces that are typically mounted on an upright display device 13, the electronic controls being readily manually programmable by a user standing on the belt 16. The electronic controls are typically interconnected to conventional electrical energy feed control devices such as a variable resistor, rheostat, potentiometer or the like that are in turn interconnected to the motor 26 to controllably drive the motor. Other motor speed controls mechanisms such as meshed gears, controllable transmission systems and the like can similarly be employed to enable the user to selectively control the timing and speed of the driven rotation of motor 26 and thus in turn the speed of rotation of the rollers 22, 24 and in turn the speed of rotation of the running belt 16.

The invention claimed is:

1. A treadmill comprising:

a pair of rollers mounted on a frame;

an endless running belt wound around the rollers under a selected tension;

at least one of the rollers having a roller pulley for receiving a drive belt;

a drive mechanism comprising a driven rotor having a drive pulley;

the drive belt being wound around the roller pulley and the drive pulley at a drive tension created by the selected tension in the running belt which pulls on the drive belt via the roller pulley.

2. The treadmill of claim 1 wherein the drive mechanism is fixedly mounted to the frame, the drive tension in the drive belt being created by the selected tension in the running belt pulling against the fixedly mounted drive mechanism through the drive pulley.

3. The treadmill of claim 1 wherein at least one of the drive pulley and the roller pulley is adapted to enable the drive belt to be readily manually released from being wound around the drive pulley or the roller pulley upon relaxation of tension in the running belt to a selected degree.

4. The treadmill of claim 1 wherein the at least one roller having the roller pulley is movable toward the fixedly mounted drive mechanism upon relaxation of the selected tension in the running belt a distance sufficient to enable the drive belt to be readily manually released from being wound around the drive pulley.

5. The treadmill of claim 1 wherein the roller pulley is mounted on an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

6. The treadmill of claim 1 wherein the roller pulley is mounted on an axle that is slidably mounted within a slot mechanism for back and forth travel within a slot, the slot mechanism having a release aperture for removal of the axle from the slot on relaxation of the tension in the running belt to a selected degree.

7. The treadmill of claim 1 further comprising a mechanism for selectively adjusting the selected tension in the running belt.

8. The treadmill of claim 7 wherein the mechanism for selectively adjusting the selected tension in the running belt comprises a separation adjustment device fixedly interconnected to the frame and adjustably engageable with one of the rollers to enable the rollers to be adjustably moved toward and away from each other.

9. A treadmill comprising:

a pair of rollers mounted on a frame;

an endless running belt wound around the rollers;

at least one of the rollers having a roller pulley for receiving a drive belt;

a drive mechanism comprising a driven rotor having a drive pulley, the drive belt being wound around the roller pulley and the drive pulley;

the drive mechanism being fixedly mounted to the frame; the running belt being maintained under a selected tension that acts through the roller pulley to maintain the drive pulley under tension.

10. The treadmill of claim 9 wherein the rollers are adjustably movable toward and away from each other to enable the tension in the running belt to be selectively adjusted.

11. The treadmill of claim 9 further comprising a separation adjustment device fixedly interconnected to the frame and adjustably engageable with one of the rollers to enable the rollers to be adjustably moved toward and away from each other.

12. The treadmill of claim 9 wherein the roller pulley is mounted on an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

13. The treadmill of claim 9 wherein the roller pulley is mounted on an axle that is slidably mounted within a slot mechanism for back and forth travel within a slot, the slot mechanism having a release aperture for removal of the axle from the slot on relaxation of the tension in the running belt to a selected degree.

14. The treadmill of claim 9 further comprising a mechanism for selectively adjusting the selected tension in the running belt.

15. A treadmill comprising:

a pair of rollers mounted on a frame;

an endless running belt wound around the rollers under a selected tension;

at least one of the rollers having a roller pulley for receiving a drive belt;

a drive mechanism comprising a driven rotor having a drive pulley, the drive belt being wound around the roller pulley and the drive pulley;

the drive mechanism being fixedly mounted to the frame;

at least one of the drive pulley and the roller pulley being adapted to enable the drive belt to be readily manually released from being wound around the drive pulley or the roller pulley upon relaxation of the selected tension in the running belt to a selected degree.

16. The treadmill of claim 15 wherein the roller pulley is mounted on an axle that is slidably mounted within a slot mechanism for back and forth travel within a slot, the slot mechanism having a release aperture for removal of the axle from the slot on relaxation of the tension in the running belt to a selected degree.

17. The treadmill of claim 15 wherein the roller pulley is mounted on an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

18. The treadmill of claim 15 further comprising a mechanism for selectively adjusting the selected tension in the running belt.

19. The treadmill of claim 18 wherein the mechanism for selectively adjusting the selected tension in the running belt comprises a separation adjustment device fixedly interconnected to the frame and adjustably engageable with one of the rollers to enable the rollers to be adjustably moved toward and away from each other.

20. A treadmill comprising:

a pair of rollers mounted on a frame;

an endless running belt wound around the rollers under tension;

at least one of the rollers having a roller pulley for receiving a drive belt;

a drive mechanism comprising a driven rotor having a drive pulley, the drive belt being wound around the roller pulley and the drive pulley;

the drive mechanism being fixedly mounted to the frame;

the roller pulley being mounted for back and forth travel toward and away from the drive mechanism.

21. The treadmill of claim 20 wherein the roller pulley includes an axle that is slidably mounted within a slot mechanism for back and forth travel within a slot, the slot mechanism having a release aperture for removal of the axle from the slot on relaxation of the tension in the running belt to a selected degree.

22. The treadmill of claim 20 wherein the tension in the running belt creates tension in the drive belt and wherein the roller pulley is includes an axle that is slidably mounted within a slot mechanism for back and forth travel within a slot, the slot mechanism having a rearward stop edge or surface fixedly located relative to the drive pulley in a position that is selected to limit travel of the axle away from the drive pulley to a degree that limits the tension in the drive belt to a selected maximum.

* * * * *